US005079589A

United States Patent [19]

Shibata et al.

[11] Patent Number: 5,079,589

[45] Date of Patent: Jan. 7, 1992

[54] DETACHABLE DEVELOPING UNIT IN AN IMAGE FORMING APPARATUS

[75] Inventors: Kiyotaka Shibata, Takatsuki; Seiichi Shirasaki, Neyagawa, both of Japan

[73] Assignee: Mita Industrial Co. Ltd., Osaka, Japan

[21] Appl. No.: 527,833

[22] Filed: May 24, 1990

[30] Foreign Application Priority Data

Jul. 18, 1989 [JP] Japan ..... 1-186537
Dec. 8, 1989 [JP] Japan ..... 1-319566

[51] Int. Cl.[5] ..... G03G 15/06
[52] U.S. Cl. ..... 355/245; 355/260
[58] Field of Search ..... 355/245, 260, 210, 200

[56] References Cited

U.S. PATENT DOCUMENTS 4,839,691 6/1989 Tagawa et al. ..... 355/260
4,916,490 4/1990 Tanaka et al. ..... 355/245
4,937,625 6/1990 Kato et al. ..... 355/245
4,956,668 9/1990 Arnold et al. ..... 355/245

FOREIGN PATENT DOCUMENTS 61-22367 1/1986 Japan .
61-99177 5/1986 Japan .

*Primary Examiner*—R. L. Moses
*Attorney, Agent, or Firm*—Beveridge, DeGrandi & Weilacher

[57] ABSTRACT

A developing unit of an image forming apparatus is for developing a latent image formed on a photoconductive drum. The developing unit comprises a developing device attachable to and detachable from the image forming apparatus body in a direction crossing the axis of the photoconductive drum, and a hopper fixed to the body of the image forming apparatus for supplying toner to the developing device connected to the body of the image forming apparatus. The hopper has a toner supply pipe which can assume a supply position, in which it is inserted in a connecting opening of the developing device, and a drawn position, in which it is drawn out from the developing device. The developing unit may have a lever to move the toner supply pipe to the drawn position. The lever can assume a first position not to allow the developing device to be withdrawn when the end of the toner supply pipe is in the supply position, and a second position to allow the developing device to be withdrawn when the end of the toner supply pipe is in the drawn position.

11 Claims, 11 Drawing Sheets

DETACHABLE DEVELOPING UNIT IN AN IMAGE FORMING APPARATUS

BACKGROUND OF THE INVENTION

The present invention relates to a developing unit, more particularly, to a developing unit for developing a latent image on a photoconductor in an image forming apparatus such as a copying machine or a printer.

In a copying machine, for example, a reading unit reads information from original, and then a latent image is formed on a photoconductive drum as determined by the read image information. A developing unit is provided in the copying machine for developing the latent image. The developing unit consists mainly of a developing container having a developing roller and an agitating roller therein, and a hopper for supplying toner to the developing container.

Such a developing unit must be drawn out, or detached, from the copying machine body when the toner is supplied to the developing unit, or during maintenance thereof. Conventionally, the developing unit is moved in the direction parallel to the axis of the photoconductor, or in the rear-to-front direction, when the developing unit is attached or detached. However, since the developing unit must be set very close to the photoconductor, the developing unit may hit or scratch the surface of the photoconductor, damaging the surface. In order to guard the photoconductor against damage when the developing unit is attached or detached, the developing unit may be slid upward and downward as the technology described in U.S. Pat. No. 4,702,587 and Japanese Patent Laying-Open No. 214778/1988 discloses.

In the above copying machine, an operator can obtain different color copy by exchanging developing units. However, since the developing unit is large because it comprises a hopper fixed to the developing device, it is cumbersome to exchange developing units. Although the hopper storing toner could be minimized to facilitate the exchanging operation, this would counter current situations, in which copying machines are frequently used and a large amount of copies must be made very quickly.

Usually, copying machines consume black toner to a much greater extent than other toner, such as red. However, in the above conventional units the developing devices and hoppers are fixed together and the volume of each of these hoppers is the same. Therefore, every hopper must be able to accommodate the toner which is consumed most, so that the developing units must be unnecessarily large.

SUMMARY OF THE INVENTION

It is an object of the present invention to provide a developing unit of an image forming apparatus in which the developing color can be easily and efficiently changed by moving the developing unit upward and downward.

It is another object of the present invention to provide a developing unit of an image forming apparatus having a hopper, a developing device detachable from the hopper and a pipe connecting the hopper and the developing device therebetween, wherein the pipe is not obstructive to the developing device.

It is a further object of the present invention to provide a developing unit of an image forming apparatus having a hopper, a developing device detachable from the hopper, and a pipe connecting the hopper and the developing device therebetween, wherein the pipe is not damaged when the developing device is connected or disconnected.

(1) According to an aspect of the present invention, a developing unit of an image forming apparatus for developing a latent image formed on a photoconductor comprises a developing device and a hopper. The developing device can be attached to and detached from the body of the image forming apparatus in a direction crossing the direction of the axis of the photoconductor. The hopper is affixed to the body of the image forming apparatus to supply toner to the developing device.

In this developing unit, since the developing device is moved in a direction crossing the direction of the axis of the photoconductor, the developing device does not damage the surface of the photoconductor when the developing device is moved.

Furthermore, the toner of a particular color frequently used may be stored in the hopper affixed to the body of the image forming apparatus, and another kind of toner may be stored in another developing device having no hopper, so that a large amount of frequently used toner can be stored, whereas the developing devices can be compact, to make the exchanging operation simpler. Thereby, when the development is carried out with toner of the aforementioned kind, the toner stored in the developing device can solely be used, whereby the developing system becomes more efficient.

(2) According to another aspect of the present invention, a developing unit of an image forming apparatus comprises a developing device, a hopper, a toner supply pipe, and means for moving the pipe. The developing device is detachable from the body of the image forming apparatus. The hopper is fixed to the body of the image forming apparatus for containing toner. The pipe, for supplying toner from the hopper to the developing device, is movable, whereby an end of the pipe can be positioned in a toner supply opening in a toner-supply position, and out of the opening in a drawn position. The pipe-moving means moves the pipe so that the end of the pipe is drawn out of the opening.

According to the aspect herein, the pipe is in the drawn position, out of the developing device, while the developing device is being connected to or disconnected from the body of the image forming apparatus. Therefore, the pipe does not obstruct the developing device when the developing device is being moved, so that the pipe is not damaged. Furthermore, when the developing device is connected to the body of the image forming apparatus, the pipe is in the supply position, in which the end of the pipe is inserted in the opening of the developing device, so that toner can be supplied from the hopper affixed to the body of the image forming apparatus, through the pipe, to the developing device.

(3) According to yet another aspect of the present invention, in the developing unit of the image forming apparatus of the above second aspect, the means for moving the pipe is a lever, whereby the pipe is moved between the supply position and the drawn position. The lever can be set both in a first position, not to allow the developing device to be withdrawn, wherein the end of the pipe is in the supply position, and in a second position, to allow the developing device to be withdrawn, wherein the end of the pipe is in its drawn position.

According to the aspect herein, the means for moving the pipe comprises a lever, and the lever is set in the first position, not to allow the developing device to be withdrawn, wherein the end of the pipe is in the supply position. Similarly, the lever is set in the second position, to allow the developing device to be withdrawn, wherein the end of the pipe is in the drawn position. Consequently, wherein the end of the pipe is inserted in the developing device, the developing device cannot be withdrawn, so that the pipe cannot be damaged by an incorrect operation.

These and other objects and advantages of the present invention will be more fully apparent from the following detailed description.

DESCRIPTION OF THE PREFERRED EMBODIMENT

Outline of Copying Machine Structure

Figure 1:
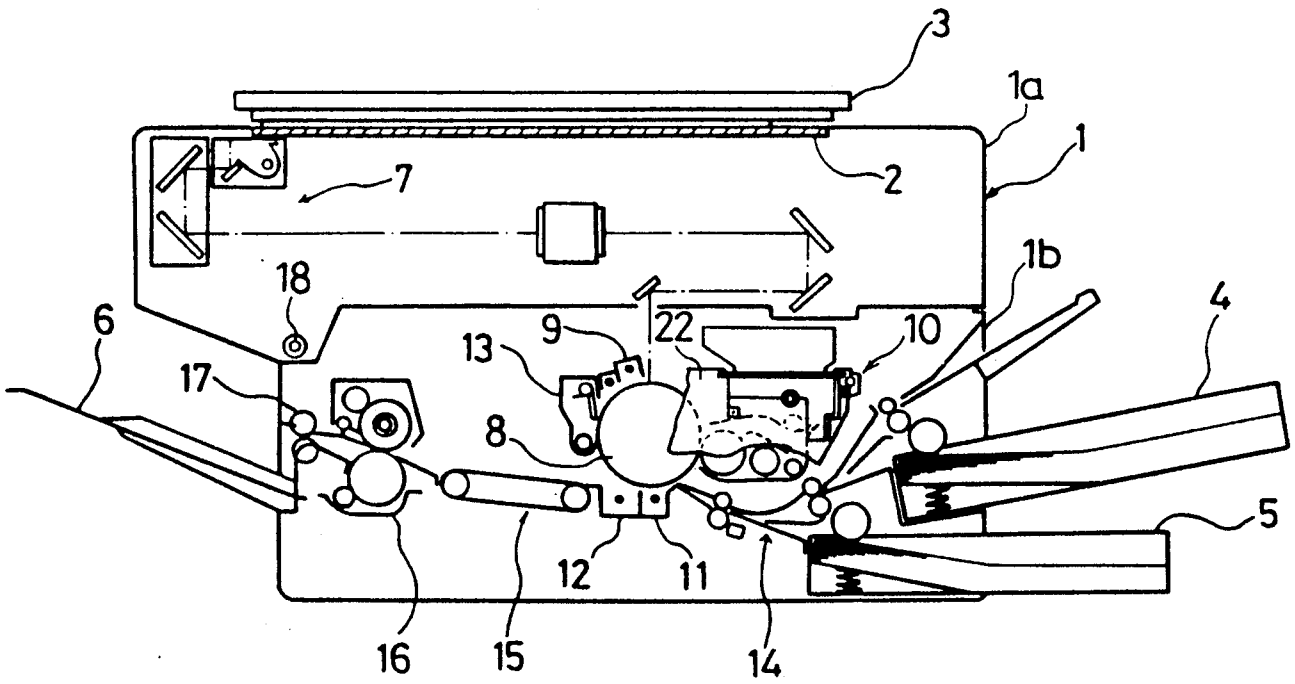
FIG. 1 is a sectional, schematic view showing a copying machine having a developing unit cartridge according to the present invention.

FIG. 1 shows the outline of the structure of an electrostatic-process copying machine having a developing unit in accordance with an embodiment of the present invention.

A machine body 1 consists of the upper portion 1*a* and the lower portion 1*b*. The upper portion 1*a* can pivot on a hinge 18 at the left side of the figure to open the machine body 1. The machine body 1 has a contact glass 2 in the upper surface and an original holder 3 thereon which can be opened. On the right side of the machine body in the figure, detachable paper cassette cases 4 and 5 are attached. On the left side of the machine body 1, a copy tray 6 is attached wherein copied paper is received.

In the machine body 1, an optical exposure system 7 for obtaining information from the original image is located in the upper portion 1*a*. The exposure system 7 consists of a light source, mirrors and lenses. Disposed, as a photoconductor, in the central part of the lower portion 1*b* is a photoconductive drum 8 on which an electrostatic image is formed. Surrounding the photoconductive drum 8, there is an image forming part which consists of a corona-generating device 9 for charging the photoconductive drum 8 with a predetermined level of electric charge, a developing unit 10 for developing an electrostatic image, a transfer unit 11 for transferring a toner image to paper, a detach unit 12 for detaching paper from the photoconductive drum 8, and a cleaning unit 13 for removing toner from the photoconductive drum 8, in that order. A paper transferring path 14 is provided between the paper cassette cases 4 and 5 and the image forming part. In a part of the paper stream lower than the image forming part, a paper transportation device 15 is provided. A fixing unit 16 for fixing a transferred image on the fed paper is disposed between the paper transferring device 15 and the copy tray 6. Beyond the fixing unit 16 in the paper flow, a pair of rollers 17 are provided for disposing of paper to the copy tray 6.

Outline of Structure of Developing Unit

Figure 2:
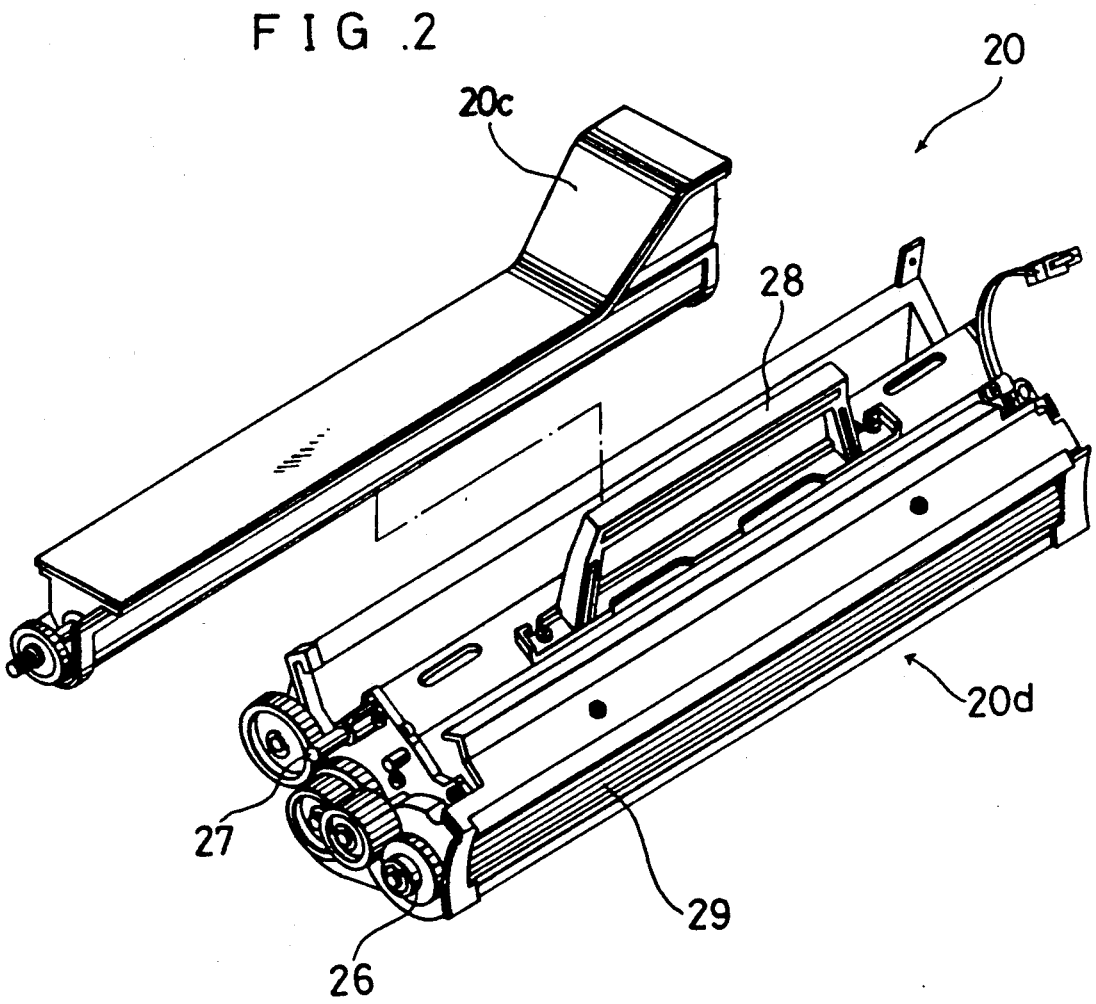
FIGS. 2, an isometric view, and 3, a sectional view, are views showing decomposed parts of a developing unit of the copying machine.
Figure 3:
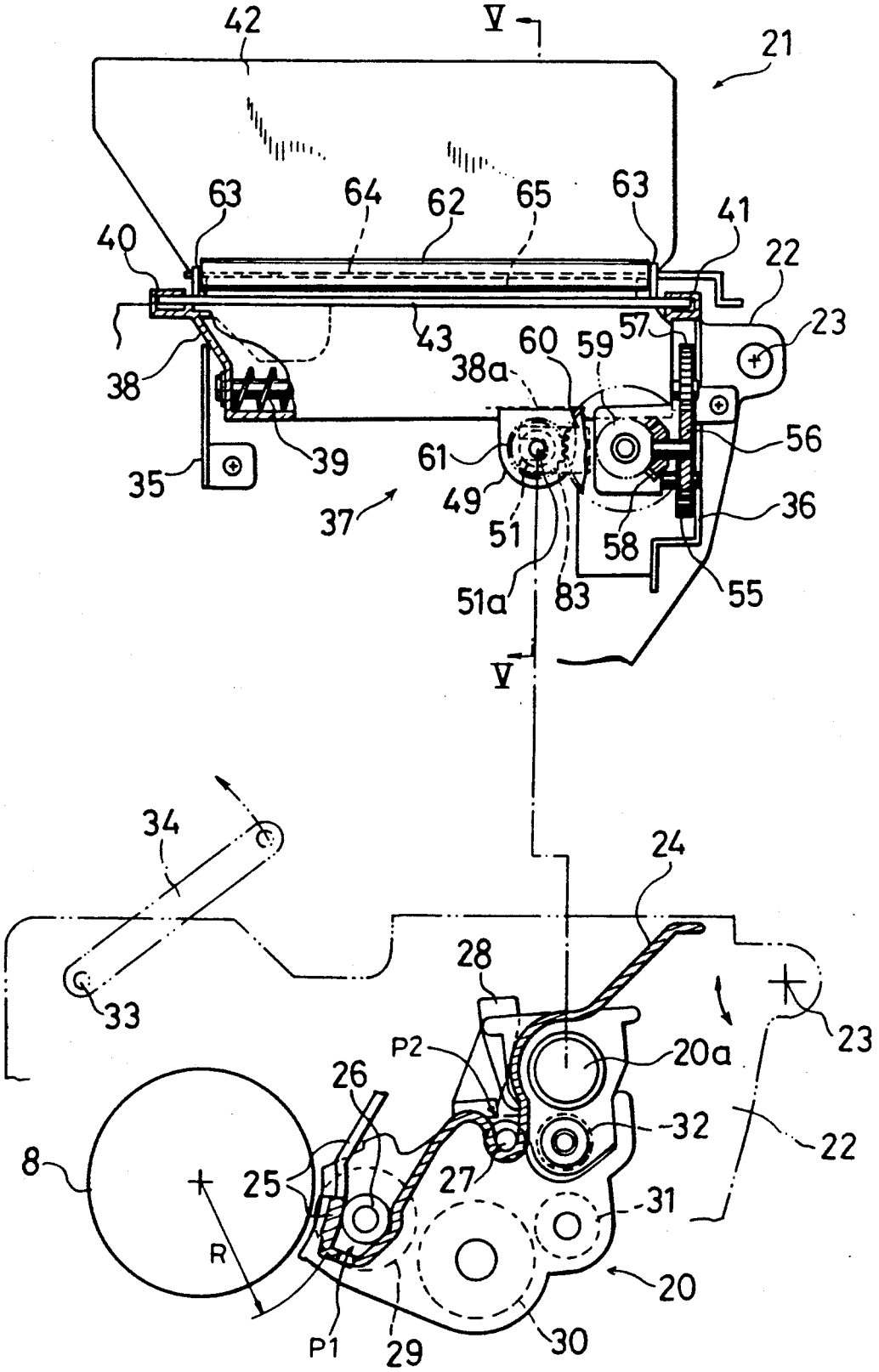

Referring to FIG. 3, the developing unit 10 consists mainly of a developing device 20 and a hopper 21 for supplying toner to the developing device 20. The developing device 20 consists of a body 20*d* and a supply part 20*c* on the body 20*d* (shown in FIG. 2). The developing device 20 is placed between a front plate 22 and a back plate (not shown), where the side of the copying machine closer to an operator is referred to as the front side and the side opposite is referred to as the back side. The developing device 20 is slidable in the direction perpendicular to the axis of the photoconductive drum 8, or upward in this embodiment, to be attached and detached. The front plate 22 located at the front in the lower part 1*b* is pivotable upward, or clockwise, on a fulcrum 23, from the position shown in FIG. 3. The back plate, located at the back in the lower portion 1*b*, is pivotable in the same manner as the front plate 22.

Figure 4:
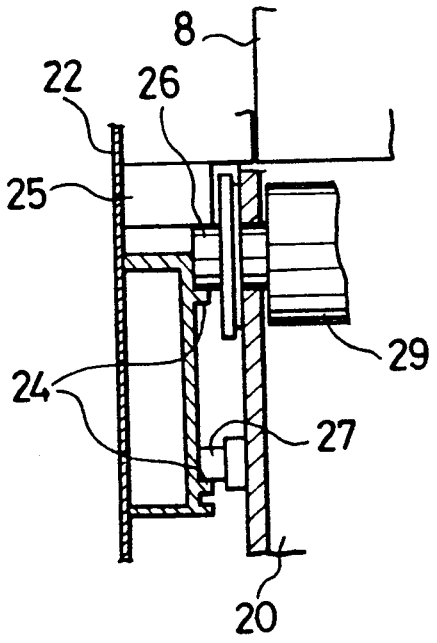
FIG. 4 is a sectional partial view of a fixing part of the developing unit.

Referring to FIGS. 3 and 4, guides 24 and 25 for guiding the developing device 20 to the predetermined position are formed on the inside of the front plate 22 and of the back plate. Meanwhile, the developing device 20 has support members 26 and 27 on the side walls which project into the guides 24 and 25. The support members 26 and 27 are supported by a first pocket P1 and a second pocket P2 formed by the guides 24 and 25.

In the first pocket P1, and inside surface of the guide 25 supporting the support member 26 of the developing device 20 comprises a part of an arc of radius R whereof the center coincides with the axis of the photoconductive drum 8. In addition, a handle 28 is attached to the upper part of the developing device 20 in order to draw up the developing device 20.

Structure of Developing Device

Figure 5:
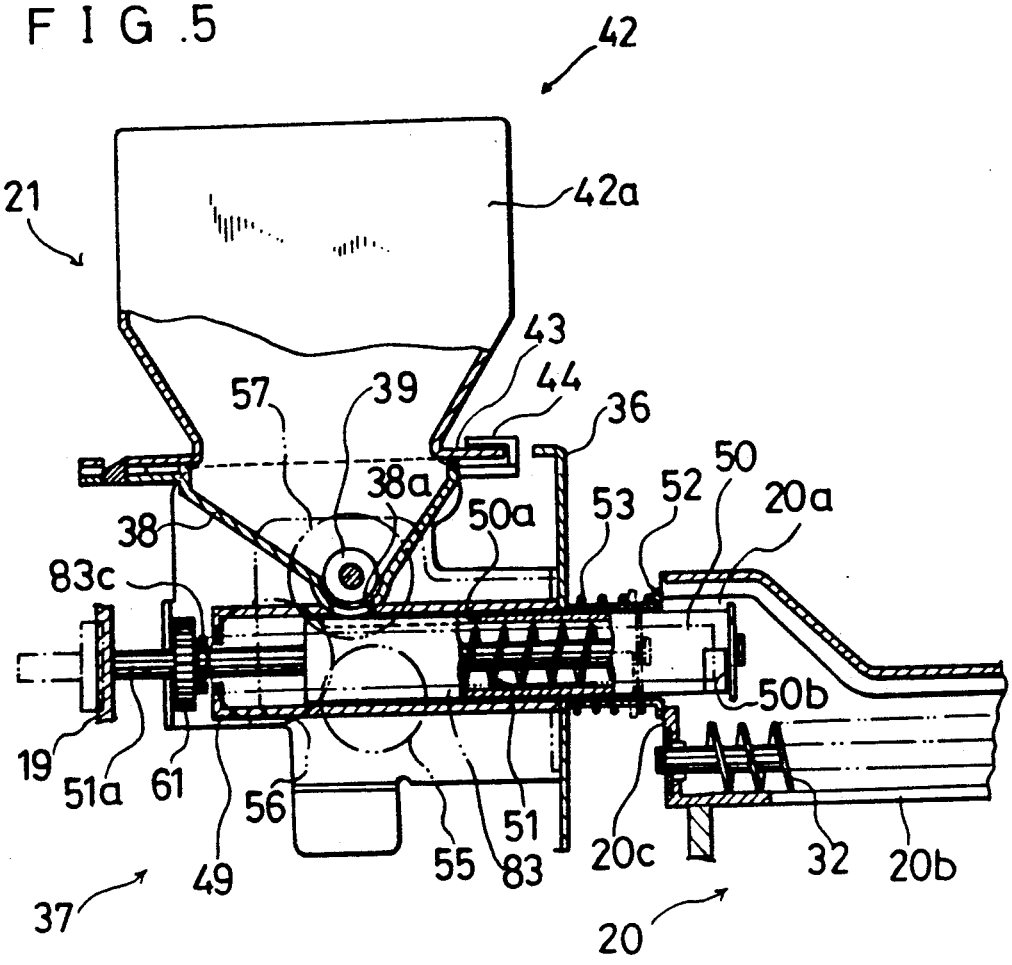
FIG. 5 is a sectional view taken along the line V—V of FIG. 3.
Figure 6:
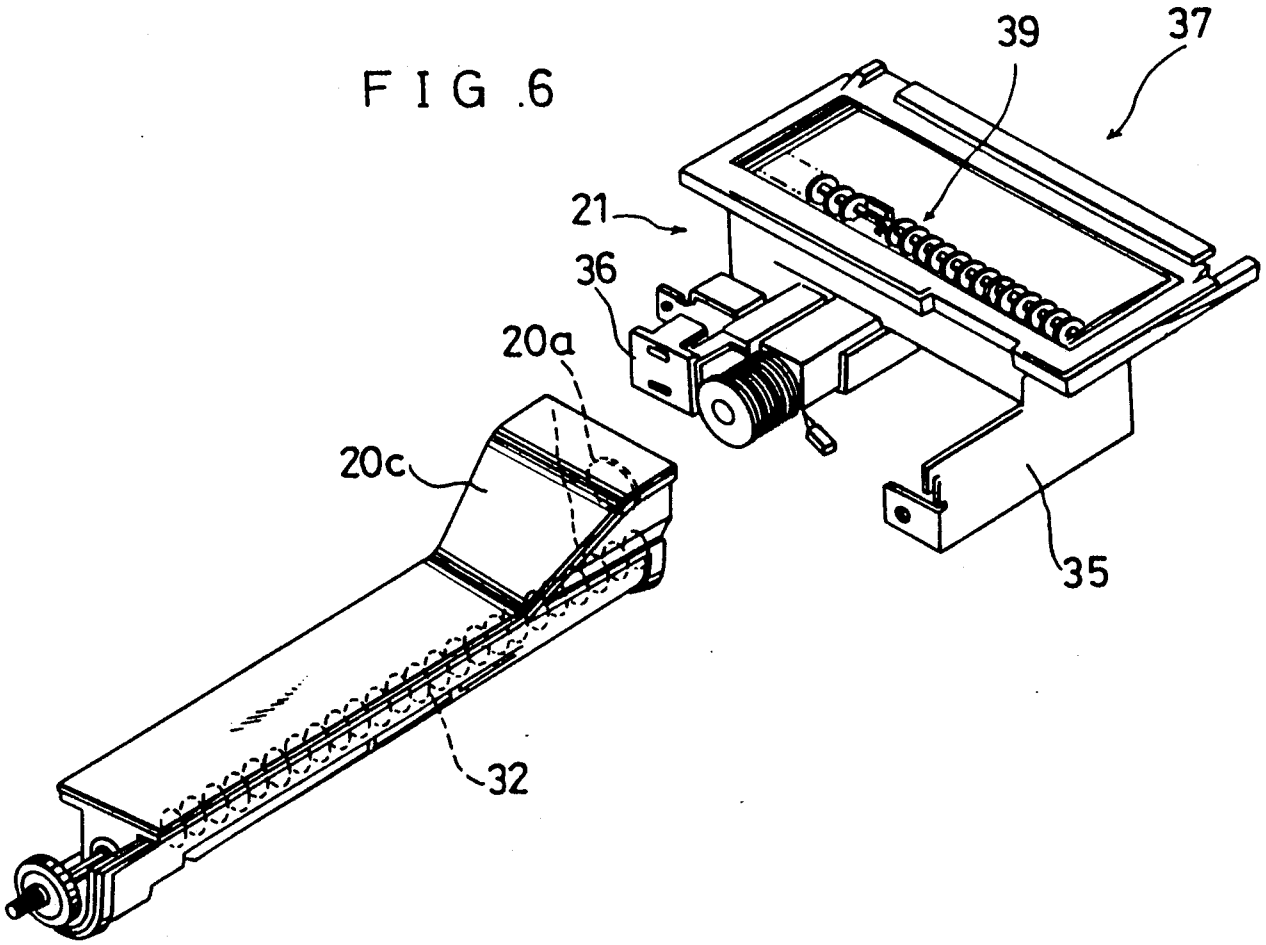
FIGS. 6 and 7 are isometric views showing toner transporting paths between a hopper and a developing device.

Similarly to the conventional developing device, the developing device 20 has in its body 20*d* a developing roller 29 for supplying toner to the photoconductive drum 8, a scooping rotor 30 for scooping developer consisting of toner and carrier to the developing roller 29, and an agitation roller 31 for agitating the developer in the developing device 20, all of which are rotatable. Above the agitation roller 31, a spiral 32, shown in FIGS. 5 and 6, is rotatably provided for transferring toner supplied from the hopper 21, described below, in the lateral direction of the developing device 20. Furthermore, an opening 20*a* connected to the hopper 21 is formed in the front wall of the supply part 20*c* above the spiral 32, as shown in FIGS. 5 and 6. A link member 34 is pivotally connected with a pin 33 to the upper part of the left end, in FIG. 3, of the front plate 22 which supports the developing device 20 and the photoconductive drum 8. The upper end of the link member 34 is pivotally connected to the upper portion 1*a* of the copying machine body 1.

Structure of Hopper

Referring to FIGS. 3, 5 and 6: the hopper 21 is disposed in the front of the developing device 20 and fixed to the front plate 22 with supporting plates 35 and 36. The hopper 21 consists mainly of a hopper body 37 and a cartridge 42.

Hopper Body

The hopper body 37 has a toner container 38 for containing toner. The toner container 38 has a pair of inside walls at both ends in the widthwise direction, which slope to make a "V", as in the sectional side view, and another pair of inside walls at both ends in the direction perpendicular to the widthwise direction, which slope as well. Accordingly, the container 38 opens out at its upper end. The toner container 38 has holders 40 and 41, whereof the sectional shape is similar to a "C", at the upper left and right ends. The holders 40 and 41 hold a flange 43 surrounding the opening of the toner cartridge 42, as described below. Referring to FIG. 5: another holder 44 is formed in the rear portion of the toner container 38. The holder 44 holds the flange 43 of the toner cartridge 42 similarly to the holders 40 and 41.

Referring to FIGS. 5, 7, 8 and 10: a toner supply opening 38*a* for allowing toner to drop is formed at the bottom of the toner container 38. The toner supply opening 38*a* is formed slightly on the right (in FIG. 3) of the middle in the lengthwise direction of the toner container 38 to correspond to the connecting opening 20*a* of the developing device 20, as in the view in FIG. 3. In the bottom portion of the toner container 38, a transfer means 39 is disposed to transfer the toner in the container 38 to the opening 38*a*. The transfer means 39 consists of a rod 39*d* and a transfer member. The transfer member consists of a rotor 39*a* having four wings 45, above the toner supply opening 38*a*, and a pair of spirals 39*b* and 39*c* on either side of the rotor 39*a* and opposite to each other in terms of twisting direction, for transferring the toner to the rotor 39*a*.

Figure 9:
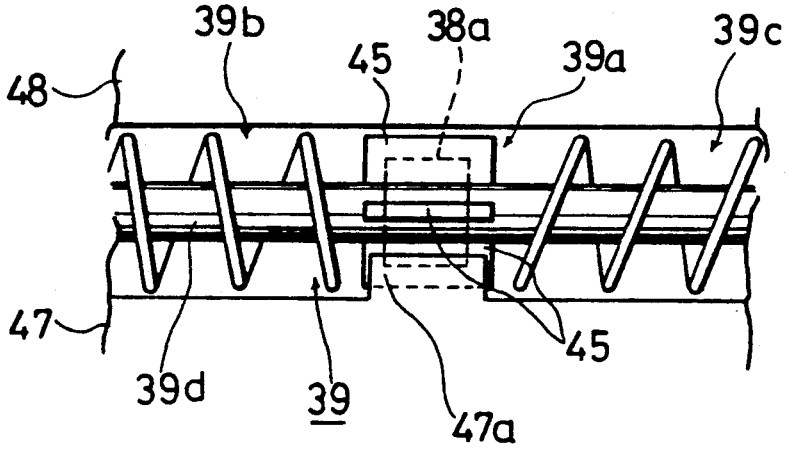
FIG. 9 is a plan view showing a part of a container.
Figure 10:
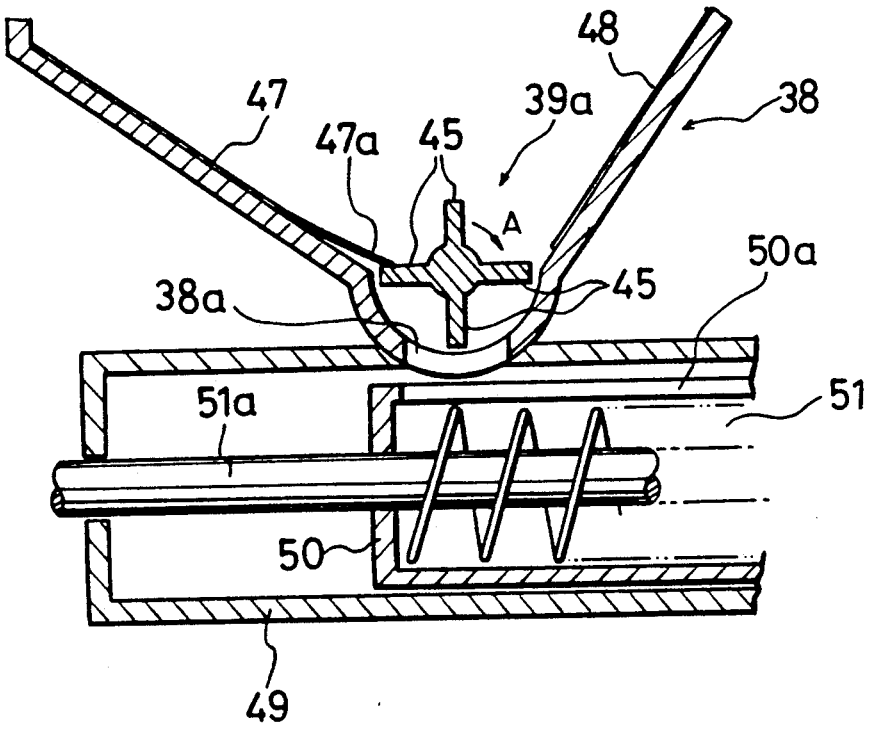
FIG. 10 is a vertically sectional view showing the bottom part of the container.

The rotor 39*a*, as shown in FIGS. 9 and 10, covers the toner supply opening 38*a* with its wings 45 whereby an excessive amount of toner cannot be supplied at a given time.

Figure 8:
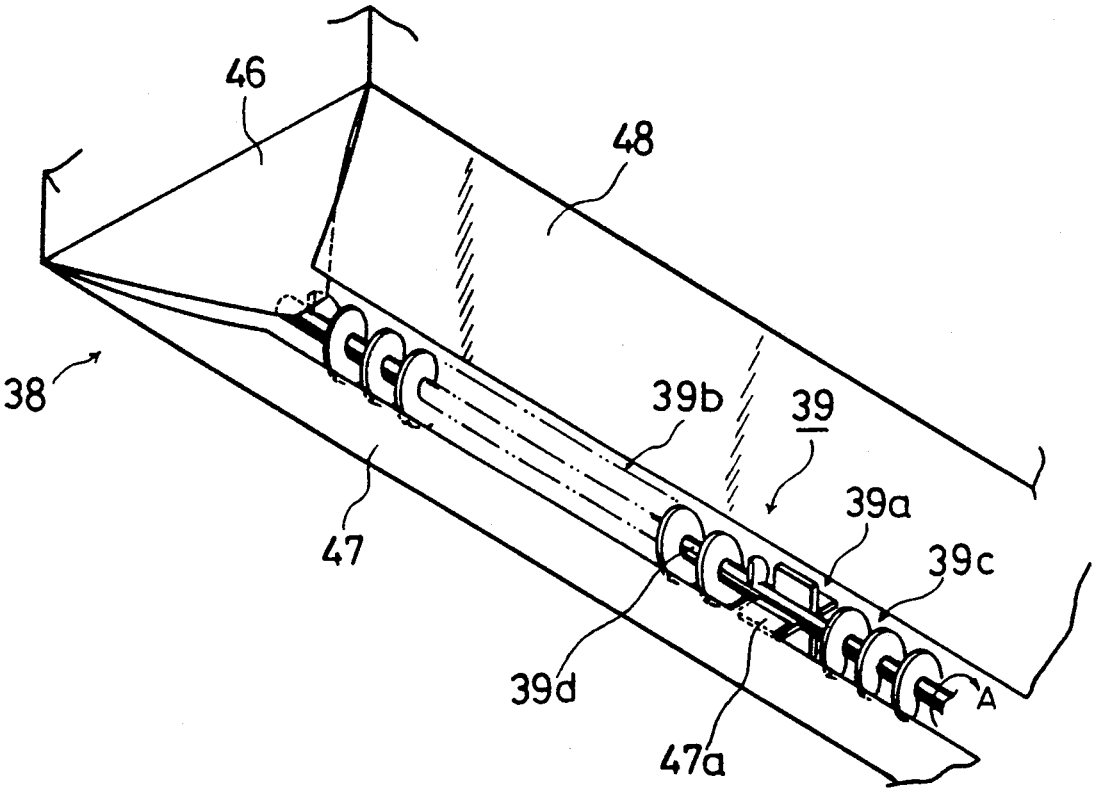
FIG. 8 is an isometric view showing the inside of a toner container.

Referring to FIG. 8: placed on a pair of sloping walls of the toner container 38 are side swing plates 46 (one of which is shown in FIG. 8), a front swing plate 47 and a rear swing plate 48, made of elastic material such as polyester film. Each swing plate 46 is attached to the inside surface of the container 38 at its upper portion to make its lower portion free. Each bottom end of the side swing plates 46 is on an end of the spiral 39*b* and 39*c*. The bottom of the side portions of the rear swing plate 48 are placed on the side swing plates 46 so that the rear swing plate 48 is swung by the oscillation of the side swing plates 46.

Part of the bottom portion of the front swing plate 47 has a projection 47*a*. The projection 47*a* is placed on a wing 45 adjacent to the front swing plate 47, as shown in FIGS. 8–10. The direction of the rotation of the transfer means 39 as shown with an arrow A in FIGS. 8 and 10 is predetermined whereby the projection 47*a* cannot be bent down towards the opening 38*a*.

Referring to FIGS. 3, 5–7: a cylindrical casing 49 provided below the toner container 38 extends in the direction perpendicular to the transfer member 39. In the cylindrical casing 49, a toner supply pipe 50 is slidably inserted. An upper opening 50*a* is formed in the upper portion of the toner supply pipe 50. The opening 50*a* always connects the inside of the pipe 50 and the toner supply opening 38*a* of the toner container 38, regardless of where the toner supply pipe 50 is located within its range of sliding. A lower opening 50*b* is formed circumferentially in the lower half of one end of the pipe 50 (at the right end in FIG. 5). A spiral 51 is provided rotatably in the pipe 50, whereby toner dropped from the toner container 38 is transported to the end of the toner supply pipe 50. The rod 51*a* of the spiral 51 protrudes from the hopper 21 through the end of the operator side (or the left side in FIG. 5) of the toner supply pipe 50 and the end of the cylindrical casing 49. Referring to FIG. 5: when the front cover 19 of the machine body 1 is closed, the front cover 19 pushes the end of the rod 51*a* with its inner surface. Accordingly, the toner supply pipe 50 is pushed into the machine body 1, and the other end of the pipe 50 moves into the opening 20*a* of the developing device 20.

In order to close the lower opening 50*b* of the pipe 50, a cover 52 slidably fits onto the tip-end portion of the toner supply pipe 50. The cover 52 can move along the toner supply pipe 50 and is always tensioned toward the other end of the toner supply pipe 50 by a spring 53.

Figure 7:
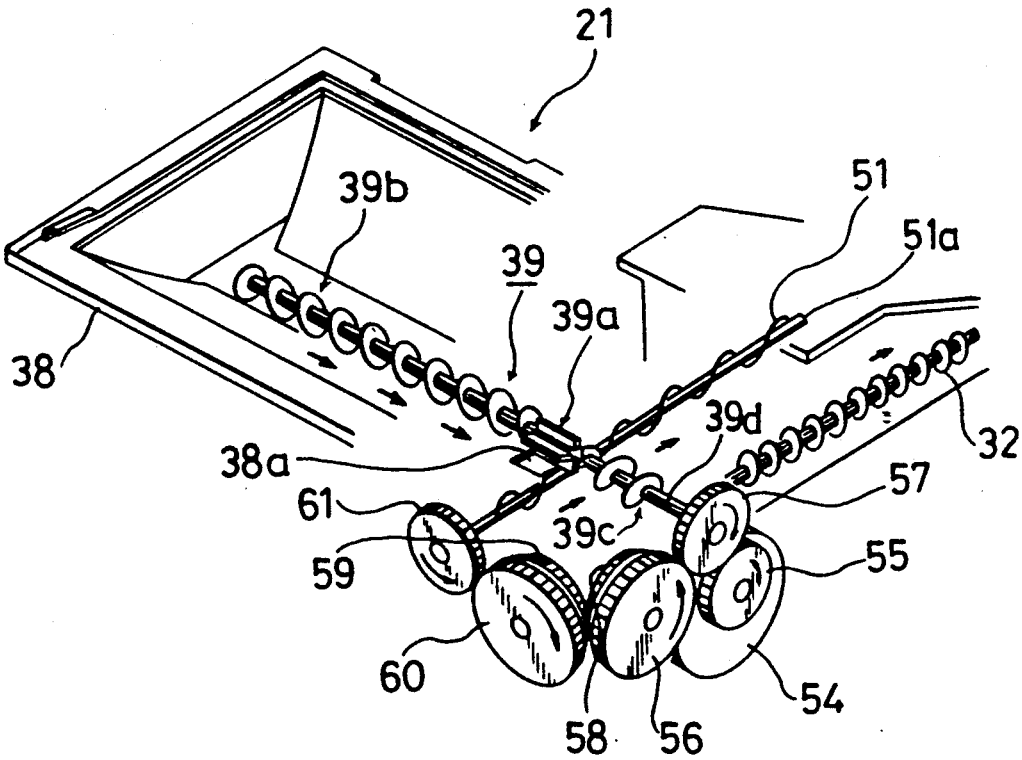

Referring to FIGS. 3, 5 and 7: a drive gear 55 is connected to a drive motor 54 in the right (in FIG. 3) end part of the hopper 21. The drive gear 55 is connected to the rod 39*d* of the transfer member 39 through a first link gear 56 and a gear 57 for toner supply. As shown in FIG. 3, the first link gear 56 is connected to a first bevel gear 58, and the bevel gear 58 is connected to a small gear 61 via a second bevel gear 59 and a second link gear 60 integrally formed thereon. The small gear 61 is fixed to the rod 51*a* extending outward from the hopper 21, accordingly thereby, the drive gear 55 drives the spiral 51.

Figure 14:
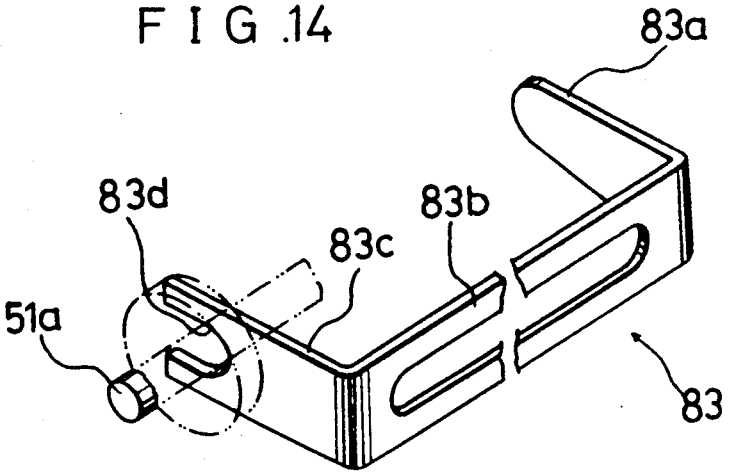
FIG. 14 is an isometric view showing a lever of the developing unit.
Figure 15A:
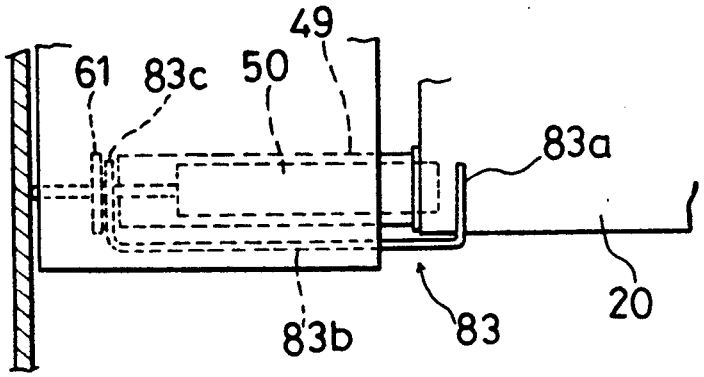
FIGS. 15A and 15B are views showing the situations wherein the developing device is connected and disconnected.

Moreover, the hopper body 37 has a lever 83 indicated by broken lines in FIG. 3, and two-dot-dash lines in FIG. 5, and shown by a line illustration in FIG. 14, respectively. The lever 83 is for moving the toner supply pipe 50 between the supply position, shown by solid lines, and the drawn position, shown by dot-dash phantom lines, in FIG. 5. The lever 83 is made of a plate formed in a C-shape in plan view and consists of a handling part 83*a*, a connecting part 83*b* and an engaging part 83*c*. The handling part 83*a* is positioned so that an operator can reach it from above to move it when the developing device 20 is exchanged. Furthermore, the handling part 83*a* is positioned whereby it obstructs the developing device 20 from being exchanged, as shown in FIG. 15A, when the toner supply pipe 50 is in the supply position. The connecting part 83*b* is slidably supported by the supporting plate 36. The engaging part 83*c* is disposed between the small gear 61 and an end of the cylindrical casing 49. The end of the engaging part 83*c* is forked in a U-shape, forming a recession 83*d* through which the rod 15*a* of the spiral 51 is disposed.

Toner Cartridge

Figure 11:
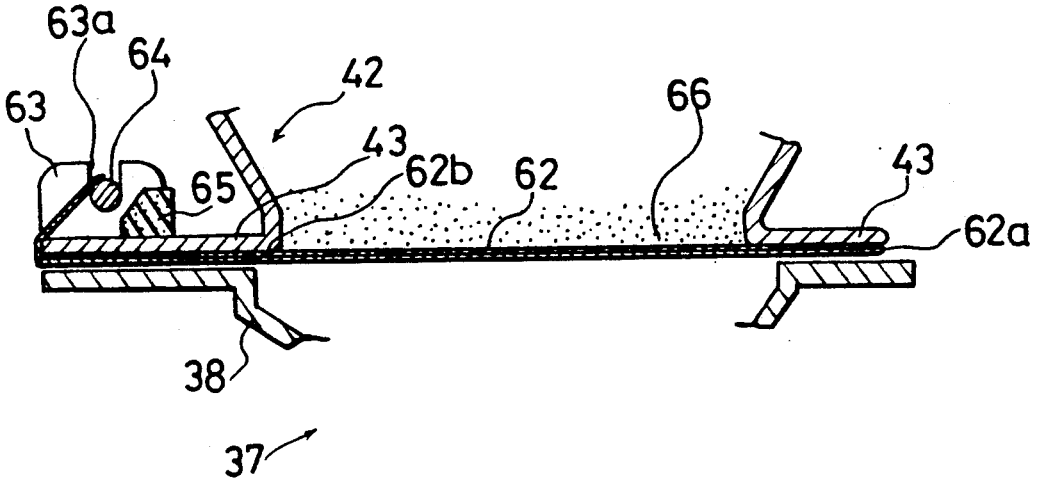
FIG. 11 is a sectional view showing a rolling mechanism for rolling up the seal member.

The toner cartridge 42 is for storing toner and supplying the toner to the toner container 38. Referring to FIGS. 5 and 11: the toner cartridge 42 consists of a cartridge body 42*a*, a seal member 62 and a rolling-up mechanism.

The cartridge body 42*a* is box-shaped and has an opening 66 at the bottom end. There are sloping walls in the lower part of the cartridge body 42*a* whereof the lower ends are closer to each other than the upper ends. The flange 43 is formed at the bottom end, as described above, and is slid into the holders 40 and 41 of the hopper body 37 when the cartridge 42 is to be attached to or detached from the hopper body 37. As shown in FIG. 5, there is a hole 43*a* for locking with which a locking projection 38*b* of the toner container 38 is engaged to fix the toner cartridge 42, when the cartridge body 42*a* is set onto the hopper body 37.

Referring to FIG. 11: the cartridge 42 has the opening 66 closed by the folded seal member 62 before use. On the flange 43, there is a mechanism with which the seal member 62 is rolled up, when the cartridge body 42*a* is set onto the hopper body 37. The mechanism consists of a supporter 63, a roller 64 and a pressing member 65. The supporter 63 is formed integrally on the operator-side part of the flange 43.

The supporter 63 has a U-shaped notch 63*a* into which the roller 64 is received rotatably. The folded seal member 62 is adhered to the roller 64 at the free end. The roller 64 has a crank-shaped end portion 64*a* for handling, referred to as a roll-up handle. The pressing member 65, made of resin having a sponge-like elasticity extends in the lengthwise direction of the seal member 62 along the roller 64. The pressing member 65 presses on the outer surface of the seal member 62 when it is rolled by the roller 64.

Setting for Use

When the developing unit 10 is set in the machine body 1, as shown in FIG. 5, the hopper 21 is fixed to the developing device 20 and then the front cover 19 is closed. Thus, the end portion of the toner supply pipe 50 is inserted into the connecting opening 20*a* of the developing device 20, because the inside surface of the front cover 19 pushes the rod 51*a* toward the right (in FIG. 5). The end of the cover 52 on the toner supply pipe 50 touches the edge of the opening 20*a* of the developing device 20, and thereupon the cover 52 is moved backward in relation to the toner supply pipe 50, pressing the spring 53, to open the lower opening 50*b* of the toner supply pipe 50.

Toner Supply

The transporting route of toner is shown in FIG. 7. The spiral 32 of the developing device 20 is continually rotated by a driving system, not shown. However, the transfer means 39 and the spiral 51 of the hopper 21 are usually stoped.

When a toner supply instruction is outputted in a copying process due to toner consumption, the drive motor 54 starts and the drive gear 55 of the hopper 21 rotates. The rotation of the drive gear 55 is transferred to the transfer means 39 through the first link gear 56 and the toner supply gear 57. As the transfer means 39 rotates, one portion of toner in the left side (in FIG. 3) is transported by the spiral part 39*b* and another portion in the right side (in FIG. 3) is transported by the spiral part 39*c* to the rotor 39*a*, respectively. The rotor 39*a* permits a constant amount of toner to go down through the toner supply opening 38*a*, by means of the wings 45.

In addition to the rotation of the transfer means 39, the rotation of the first link gear 56 is transferred to the small gear 61 through the bevel gears 58 and 59 and the second link gear 60. Accordingly, the rod 51*a* connecting with the small gear 61 rotates to cause the spiral 51 to rotate. As a result, toner dropped from the supply opening 38*a* is transported in the toner supply pipe 50 to the right (in FIG. 5). The toner transported by the spiral 51 is supplied to the supply part 20*c* of the developing device 20 through the lower opening 50*b* of the toner supply pipe 50.

The toner supplied to the toner supply part 20*c* of the developing device 20 is transported in the longitudinal direction of the supply part 20*c* by the spiral 32. Since a slot 20*b* extends in the longitudinal direction below the spiral 32, the toner is supplied through the slot 20*b* to the agitation roller 31 and the scooping rotor 30. Then, when the concentration of toner reaches a predetermined level, the toner supply instruction stops, and the drive motor 54 of the hopper 21 stops, thereby halting the toner supply operation.

In the toner supply operation as described in the above, since the toner supply opening 38*a* is located not at the end, but in the middle of the hopper 21, the transportation distance of toner in the toner container 38 is thereby short. Therefore, the residence time of toner located at the lateral ends of the container 38 is reduced, so that less amount of toner can adhere to the inner surfaces of the container 38.

The rotor 39*a* of the transfer means 39 permits only the predetermined amount of toner to fall through the opening 38*a*, and this rotor 39*a* closes the opening 38*a* with its wings 45 when the rotor 39*a* stops. Therefore, the toner cannot over-supplied, and thereby neither an excessive-toner problem nor a spreading-toner problem can occur.

Toner Movement

In the above toner supply operation, the rod 39*d* rotates to rotate the spiral part 39*b*. Since the spiral part 39*b* contacts the bottom ends of the side swing plates 46 towards each of its ends, the bottom ends of the swing plates 46 are alternately pushed up by the spiral and not pushed while the spiral 39*b* is rotating. As a result, the bottom parts of the side swing plates 46 pivot on the upper part. Furthermore, the rear swing plate 48 also swings by the oscillation of the side swing plates 46, since both side ends of the rear swing plate 48 are on the side swing plates 46.

The front swing plate 47 also swings similarly to the above, since the projection 47*a* of the front swing plate 47 is on one of the wings 45, and the bottom end of the front swing plate 47 is pushed up by the wings 45, and not contrariwise, due to the rotation of the rotor 39*a*.

Thus, the swing plates 46–48 swing against the four slopes in the toner container 38 when the toner is supplied, so that the toner in the toner container 38 can move down to the bottom, thereby not remaining on the slopes.

Exchanging Developing Device

The operation will be described as when the developing device 20 is exchanged to change developing colors. The hopper 21 usually contains toner of a particular color such as black, which is the most frequently used.

When the developing color is changed to red, for example, the lock between the upper portion 1*a* and the lower portion 1*b* of the machine body 1 in FIG. 1 is opened, and the upper portion 1*a* is rotated in the counterclockwise direction about the hinge 18 to open the body 1. Opening the upper portion 1*a* pulls up the link member 34, so that the front plate 22 and the rear plate, connected to the link members 34 with the pins 33, rotate clockwise about the fulcra 23.

Figure 15B:
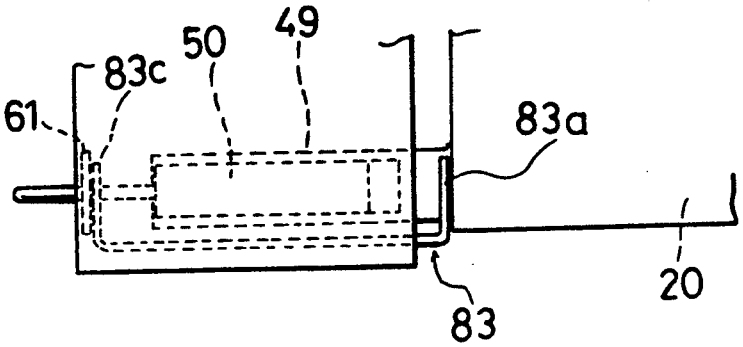

As shown in FIG. 15A, the developing device 20 cannot be drawn up, because the handling part 83*a* of the lever 83 is positioned just above the developing device 20. The handling part 83*a* of the lever 83 is then pushed forward, (or to the left in FIG. 15A). The small gear 61 is thereby pushed forward by the engaging part 83*c* of the lever 83, so that the small gear 61 carries the toner supply pipe 50 forward by means of the rod 51*a* of the spiral 51. Therefore, the end of the toner supply pipe 50 is drawn out of the opening 20*a* of the developing device 20 to assume the drawn position. At the same time, the handling part 83*a* of the lever 84 moves to the position wherein the handling part 83*a* does not obstruct the developing device 20, as shown in FIG. 15*b*.

Subsequently, the developing device 20 is drawn up by hand by means of the handle 28, so that the support members 26 and 27 of the developing device 20 exit the pockets P1 and P2, and thereupon the developing device 20 is withdrawn from the copying machine body 1 through the guides 24 and 25.

Next, a red developing device 20 which contains red toner, for example, is inserted into the machine body 1, and the support members 26 and 27 are made to go down along the guides 24 and 25 of the plate 22. Thereby, the support members 26 and 27 are supported by the pockets P1 and P2. Since the surface of the guide 25 supporting the support member 26 is a part of the arc of radius R whereof the center coincides with that of the photoconductive drum 8, the distance between the developing roller 29 and the photoconductive drum 8 is maintained strictly at the predetermined value, even if the position of the support member 26 is different from the predetermined position in the vertical direction.

The rod 51*a* is then pushed so that the end of the toner supply pipe 50 is moved into the opening 20*a* of the developing device 20 to assume the supply position. The handling part 83*a* of the lever 83 is thereby moved into a position just above the developing device 20, as the engaging part 83*c* is pushed by the small gear 61, as shown in FIG. 15A. Even if an operator forgets to push the rod 51*a*, the end of the toner supply pipe 50 nevertheless will be inserted into the opening 20*a* of the developing device 20, because the front cover 19 pushes the rod 51*a* with its inner surface as the front cover 19 is closed.

The developing device 20 containing red toner does not have the connecting opening 20*a* and the spiral 32 which are provided in the black developing device. Therefore, there is no portion which retains the cover 52, so that the lower opening 50*b* of the toner supply pipe 50 is still covered by the cover 52, due to the pressure of the spring 53, even if the toner supply pipe 50 of the hopper 21 is pushed. Furthermore, in this case, a detector such as a switch (not shown) detects the set developing device 20 which is not the black developing device 20, so that the motor for supplying toner is not activated.

When the former black developing device 20 is reinserted, the black developing device 20 is supported by the pockets P1 and P2 through an operation similar to the above operation. The rod 51*a* is then pushed by the operator, so that the end of the toner supply pipe 50 is inserted into the opening 20*a* of the developing device 20. Even if the operator does not push the rod 51*a*, the front cover 19 pushes the rod 51*a* with its inner surface when the cover 19 is closed, thereby the end of the toner supply pipe 50 automatically moves into the opening 20*a* of the developing device 20.

In the above exchange operation of the developing devices 20, the surface of the photoconductive drum 8 is not damaged, because the developing devices 20 can slide downwards to be installed and upwards to be withdrawn, guided by the guides 24 and 25. Furthermore, since only the developing devices 20, a part of the developing unit, are exchanged when the developing color is changed, the operation is facilitated. This developing unit can be also used when a great number of copies in a particular color must be made, because the most frequently used color toner can be stored in the toner cartridge 42 of the hopper 21.

Since the toner supply pipe 50 is inserted in the developing device 20 by the movement of the front cover 19 of the machine body 1, the hopper 21 and the developing device 20 are automatically connected after the developing devices 20 are exchanged. In addition, since the lower opening 50*b* of the toner supply pipe 50 is automatically covered by the cover 52 when the developing device 20 of a color instead of the particular color (black in the above embodiment) is used, the particular-color toner does not leak out from the hopper body 37.

The developing device 20 cannot be connected or disconnected until the lever 83 is shifted whereby the end of the toner supply pipe 50 is placed in the drawn position. Therefore, the developing device 20 cannot be moved up or down when the end of the toner supply pipe 50 is in the developing device 20, whereby the toner supply pipe 50 cannot be damaged by an incorrect operation.

Figure 12:
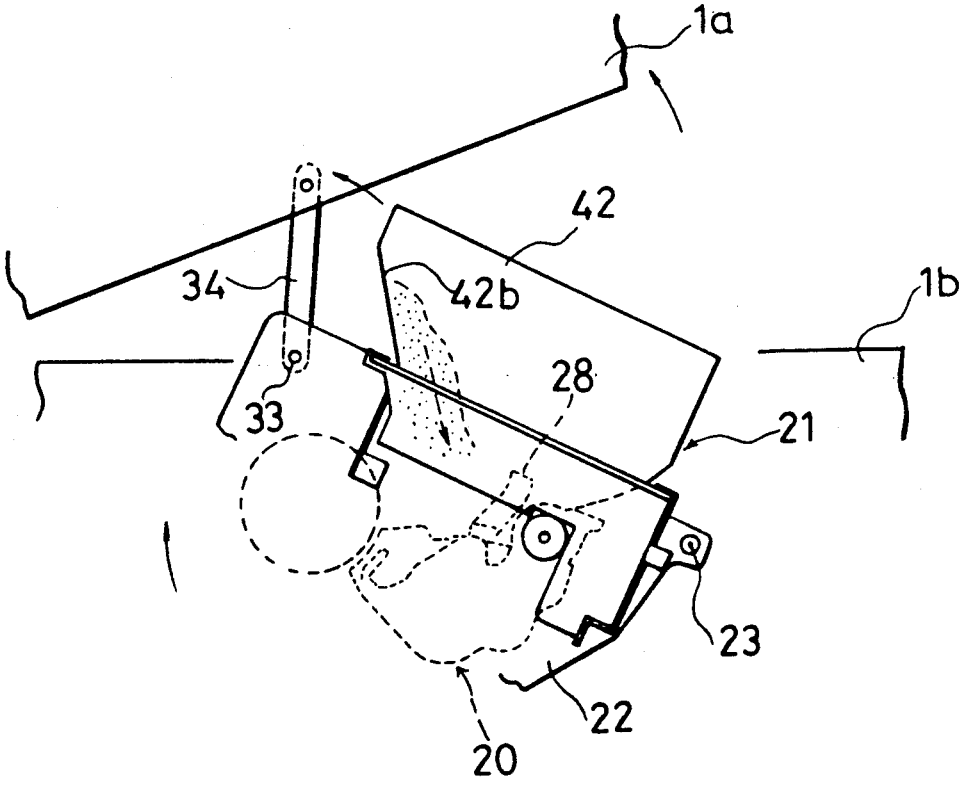
FIG. 12 is a view showing a developing unit which is being exchanged.

Furthermore, in the above developing unit, the toner cartridge 42 tilts as shown in FIG. 12 when the developing devices 20 are exchanged, so that any portion of the toner remaining on the sloping part 42*b* of the toner cartridge 42 drops to the bottom of the container. This means that all the toner can drop smoothly, even wherein a toner cartridge 42 that has been expanded laterally to increase its volume is used.

Installing Toner Cartridge

Before a new toner cartridge 42 can be installed in the developing unit, an empty toner cartridge 42 must be drawn out in the horizontal direction, therein pressing down the projection 38*b*, and then thrown away. Subsequently, the new toner cartridge 42 is slid in the horizontal direction, with its flange 43 inserted into the holders 40 and 41 of the toner container 38. As a result, the projection 38*b* is engaged with the hole 43*a*, formed in the flange 43, to lock up the new toner cartridge 42.

Figure 13A:
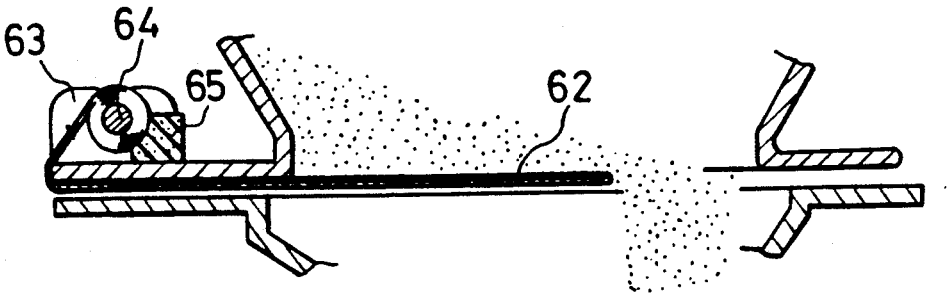
FIGS. 13A–13C are views for explaining the function of the mechanism of rolling up the seal member.
Figure 13B:
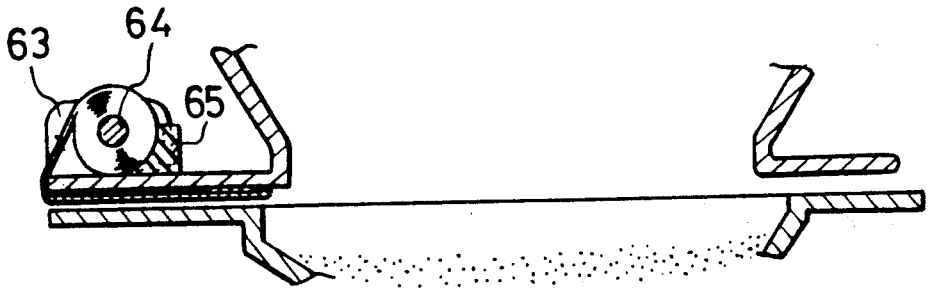
Figure 13C:
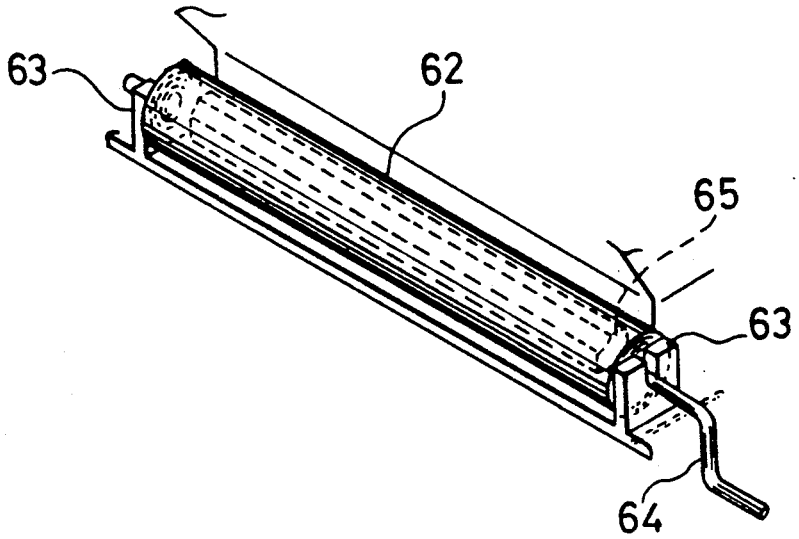

Next, the roller 64 is rotated clockwise (in FIG. 11) in order to roll up the folded seal member 62 as shown in FIGS. 13A and 13B. As the seal member 62 is rolled up by the roller 64, its outer surface pressed by the pressing member 65, as shown in FIG. 13C.

Since the rolled-up seal member 62 is pressed by the pressing member 65, expansion of the diameter of the rolled seal member 62 due to its elasticity does not occur. Furthermore, the pressing member 65 can clean the seal member 62 of toner adsorbed on its surface, as the seal member 62 is rolled up. Therefore, the rolling-up mechanism in this embodiment does not require any one-way mechanism to fix the direction of rolling, whereas a conventional rolling mechanism needs a one-way mechanism to ensure that the surface of the seal member with toner is always placed inside. Moreover, since the pressing member 65 keeps the rolled seal member 62 from expanding, as described above, the variety of the material which may constitute the seal member 62 is less limited; thereby the degree of freedom of its material is increased.

MODIFICATIONS (a) In order to expose the end of the toner supply pipe 50, the lever 83 is employed in the foregoing embodiments, but the structure can be modified.

For example, a spring can be disposed between the small gear 61 and the cylindrical casing 49 shown in FIG. 5. As the front cover 19 is opened, the spring makes the small gear 61 and the toner supply pipe 50 move out, to assume the drawn position.

In another modification, the handle 28 of the developing device 20 may be rotatable whereby the rotation of the handle 28 causes the lever 83 to shift for setting the end of the toner supply pipe 50 either in the supply position or in the drawn position.

(b) A copying machine to which the present invention is applied is not limited to the clamshell type in which a copying machine body 1 consists of the upper portion 1*a* and a lower portion 1*b* for opening, although the present invention is applied to the clamshell type in the above embodiments. For example, the present invention may be applied to a copying machine having a slidable contact glass. In this type of copying machine, after the contact glass is slid out from its position over the machine body to make an opening in the upper portion, the developing units can be exchanged through the opening.

(c) The present invention can be applied to other types of image forming apparatuses, such as a printer and a facsimile, although the developing unit according to the present invention is applied to a copying machine in the above embodiments.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A developing unit of an image forming apparatus including a body having a pair of side plates and a photoconductor, for developing a latent image formed on said photoconductor comprising:

a developing device connectable to and disconnectable from said body in a direction crossing the direction of the axis of said photoconductor, having a connection opening in a side wall thereof; and a hopper located on the outside of one of said side plates for supplying toner to said developing device connected to said body, said hopper including a toner container for containing toner, and transporting means positioned under said toner container for transporting the toner to said developing device; said transporting means including a toner supply pipe having a first opening communicating with a toner supply opening at one end and a second opening at the other end; said toner supply pipe being movable so that an end of said pipe is capable of taking a supply position, in which the end of said pipe is inserted in said connection opening of said developing device, and a drawn position, in which the end of said pipe is drawn out of said developing device.

2. A developing unit according to claim 1, wherein said toner container has in the bottom part a toner supply opening to allow the toner to drop, and a spiral which rotates in order to transport the toner contained in the container to said toner supply opening.

3. A developing unit according to claim 1, wherein said transporting means further comprises a spiral rotatably placed in said toner supply pipe for transporting the toner dropped from said toner container through said second opening.

4. A developing unit according to claim 3, further comprising:

a cover placed on an end portion of said toner supply pipe slidably to open and close said second opening; and a spring for tensioning said cover to cover the second opening of said toner supply pipe.

5. A developing unit according to claim 4, wherein said first opening is formed in the upper part of said toner supply pipe; and said second opening is formed in the lower part of said toner supply pipe.

6. A developing unit according to claim 3, wherein said transporting means is a means movable into the connecting opening of said developing device by the closing of the front cover of said image forming apparatus.

7. A developing unit according to claim 3, further comprising a pipe-moving means for moving said toner supply pipe into the drawn position.

8. A developing unit according to claim 7, wherein said pipe-moving means is a lever to move said toner supply pipe between the supply position and the drawn position; and said lever is able to assume a first position not to allow said developing device to be withdrawn when said toner supply pipe is in the supply position and a second position to allow said developing device to be withdrawn when the toner supply pipe is in the drawn position.

9. A developing unit according to claim 8, wherein said spiral has a rod projecting forward of the image forming apparatus through an end of said toner supply pipe.

10. A developing unit according to claim 9, wherein said rod of said spiral comprises a projecting end which is pushed toward the connecting opening of said developing device as by closing the front cover of said image forming apparatus, whereby said toner supply pipe is pushed in the same direction to enter said connecting opening.

11. A developing unit of an image forming apparatus comprising:

a developing device connectable to and disconnectable from a body of said image forming apparatus, said developing device having a toner supply opening;

a hopper affixed to the body of said image forming apparatus for containing toner;

a toner supply pipe movable to assume a supply position, in which an end of the pipe is inserted in the toner supply opening, and a drawn position, in which the end of the pipe is drawn out of said developing device; and a lever for moving the end of said pipe between the supply position and the drawn position, to assume a first position not to allow said developing device to be withdrawn when said pipe is in the supply position, and a second position to allow said developing device to be withdrawn when said pipe is in the drawn position.

* * * * *